US007204381B2

(12) United States Patent
Vincent, III et al.

(10) Patent No.: US 7,204,381 B2
(45) Date of Patent: Apr. 17, 2007

(54) WATERGUARD TUBE

(75) Inventors: John J. Vincent, III, Bethlehem, PA (US); Douglas A. Abbott, Easton, PA (US); Daniel L. King, Wantage, NJ (US)

(73) Assignee: Pechiney Plastic Packaging, Inc., Chicago, IL (US)

( * ) Notice: Subject to any disclaimer, the term of this patent is extended or adjusted under 35 U.S.C. 154(b) by 253 days.

(21) Appl. No.: 10/116,395

(22) Filed: Apr. 4, 2002

(65) Prior Publication Data

US 2003/0121876 A1 Jul. 3, 2003

Related U.S. Application Data

(60) Provisional application No. 60/345,903, filed on Dec. 31, 2001.

(51) Int. Cl.
*B65B 7/28* (2006.01)

(52) U.S. Cl. ..... 215/44; 222/212

(58) Field of Classification Search ..... 215/44, 215/45, 235, 329, 334–340, 211, 237, 216, 215/330; 222/107, 562, 563, 212, 185.1, 222/494, 546

See application file for complete search history.

(56) References Cited

U.S. PATENT DOCUMENTS 802,383 A * 10/1905 Fenn ..... 215/329
1,342,039 A * 6/1920 Balcom ..... 215/233
2,043,226 A * 6/1936 Beider et al. ..... 215/252
D212,412 S 10/1968 Hanlon ..... D9/194
4,387,818 A * 6/1983 Conti ..... 215/256
4,548,338 A 10/1985 Sander ..... 222/107
D286,747 S 11/1986 Kostanecki ..... D9/302
5,094,361 A * 3/1992 Dubach ..... 222/81
5,096,077 A * 3/1992 Odet et al. ..... 215/211
5,377,880 A * 1/1995 Moretti ..... 222/207
5,505,346 A * 4/1996 Smith ..... 222/505
5,584,418 A * 12/1996 Schroeder et al. ..... 222/92
5,603,421 A * 2/1997 Opresco ..... 215/217
5,655,687 A * 8/1997 Fitten et al. ..... 222/212
5,722,545 A * 3/1998 Rinne ..... 215/44
5,913,449 A 6/1999 Branch et al. ..... 220/677
D415,029 S 10/1999 Fenton et al. ..... D9/520
5,971,224 A * 10/1999 Garibaldi ..... 222/207
5,979,706 A 11/1999 Grussmark ..... 222/93
5,988,413 A * 11/1999 Nagel ..... 215/216
D427,073 S 6/2000 Gaffney et al. ..... D9/520
6,170,705 B1 1/2001 Schneider et al. ..... 222/92
6,223,919 B1 * 5/2001 Kuehn ..... 215/252
D443,515 S 6/2001 Fenton et al. ..... D9/521
D445,339 S 7/2001 Bazlur ..... D9/538
D447,694 S 9/2001 Leggett ..... D9/521
6,305,577 B1 10/2001 Fillmore et al. ..... 222/95
6,334,548 B1 1/2002 Ichikawa et al. ..... 222/107
6,484,909 B1 * 11/2002 Valpuesta Landa ..... 222/541.5
6,502,722 B1 * 1/2003 Shimizu et al. ..... 222/107
6,536,617 B2 * 3/2003 White et al. ..... 215/320

* cited by examiner

*Primary Examiner*—Lien M. Ngo
(74) *Attorney, Agent, or Firm*—Banner & Witcoff, Ltd.

(57) ABSTRACT

There is a tube container that is resistant to water infiltration into the cavity between the head and the cap. The tube container has a body wall and a head. The body wall defines a chamber therein. The head has a shoulder, which has an orifice therethrough in communication with the chamber. The shoulder has a ridge extending therefrom adjacent its periphery. The ridge substantially blocks the infiltration of water when the cap is secured to the head.

13 Claims, 5 Drawing Sheets

WATERGUARD TUBE

RELATED APPLICATIONS

This application claims priority of U.S. Provisional Application No. 60/345,903, filed on Dec. 31, 2001.

BACKGROUND OF THE INVENTION

1. Field of the Invention

The invention relates to a tube container that is resistant to water infiltration into the cavity between the shoulder and the cap. The tube container is particularly useful in a water-logged environment such as a shower or bath.

2. Description of the Prior Art

Tube containers are commonly employed to dispense consumer products useful in the shower or bath. Such products include shampoos, conditioners, body washes, bubble baths, styling creams and gels, and the like.

A common problem encountered with tube containers in the shower or bath is water infiltration into the cavity between the cap and the head. Such infiltration occurs when tube containers are stood on end with the cap facing down, the normal rest or storage position for most tube containers. The crevice between the cap and the shoulder is exposed to splashed or sprayed water, so the cavity between the cap and the shoulder is partially or completely filled with water. When the consumer subsequently picks up the tube container, the water in the cavity spills out—frequently onto the consumer's hands.

It would be desirable to have a tube container that is resistant to water infiltration in the shower or tub. It would further be desirable to have a tube container that does not accumulate water during storage in the shower or tub.

SUMMARY OF THE INVENTION

According to the present invention, there is a tube container that is resistant to water infiltration into the cavity between the head and the cap. The tube container has a body wall and a head. The body wall defines a chamber therein. The head has a shoulder, which has an orifice therethrough in communication with the chamber. The shoulder has a ridge extending therefrom adjacent its periphery. The ridge substantially blocks the infiltration of water when the cap is secured to the head.

DETAILED DESCRIPTION OF THE INVENTION

It was found surprising that a tube container could be made resistant to water infiltration into the cavity between the shoulder and the cap. It was found further surprising that a tube could be made that does not accumulate water in the cavity during storage in the shower or tub. In the present invention, the tube container has shoulder that has a ridge extending therefrom adjacent its periphery. The ridge substantially blocks the infiltration of water.

Figure 1:
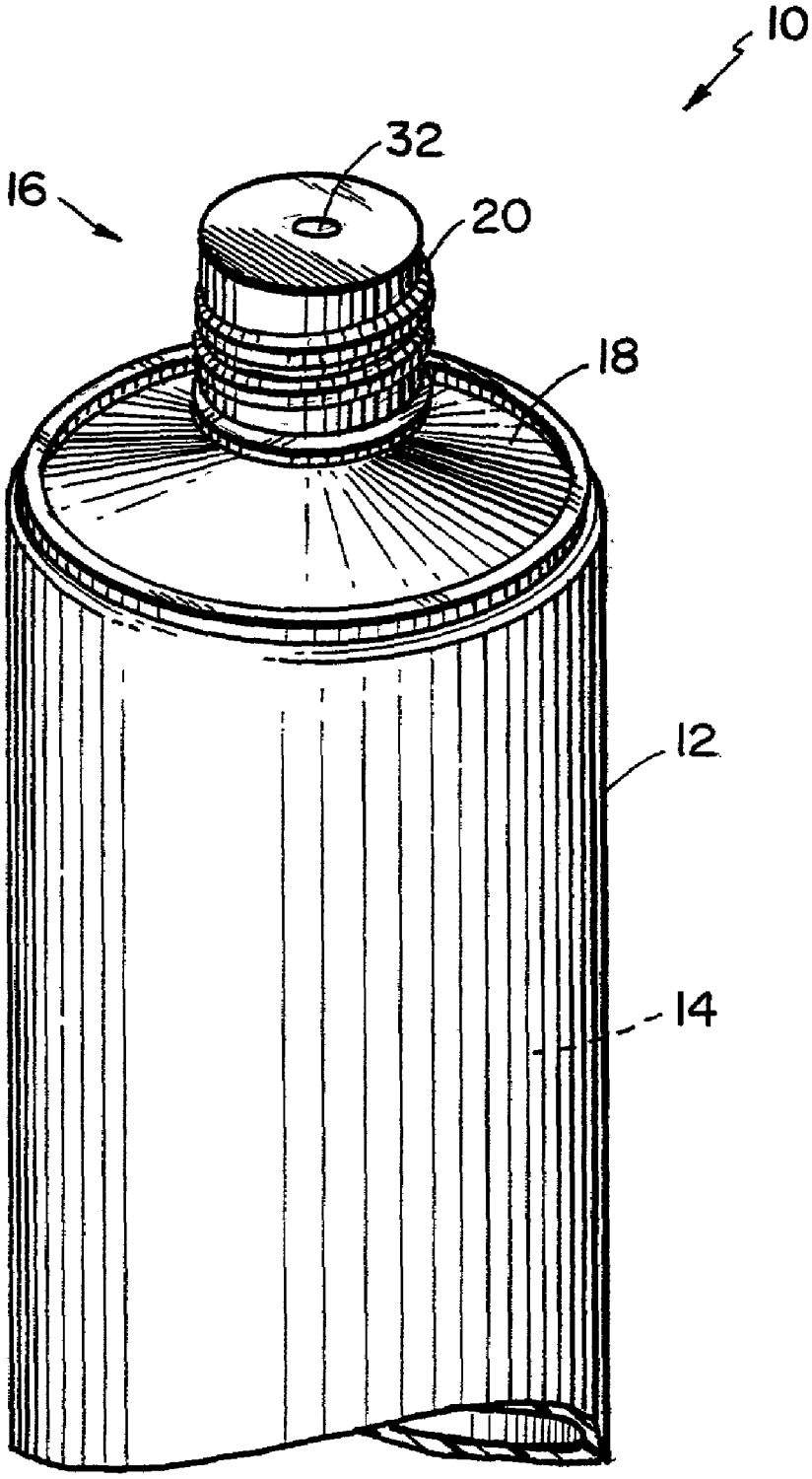
FIG. 1 is an isometric view of a tube container according to the present invention.
Figure 2:
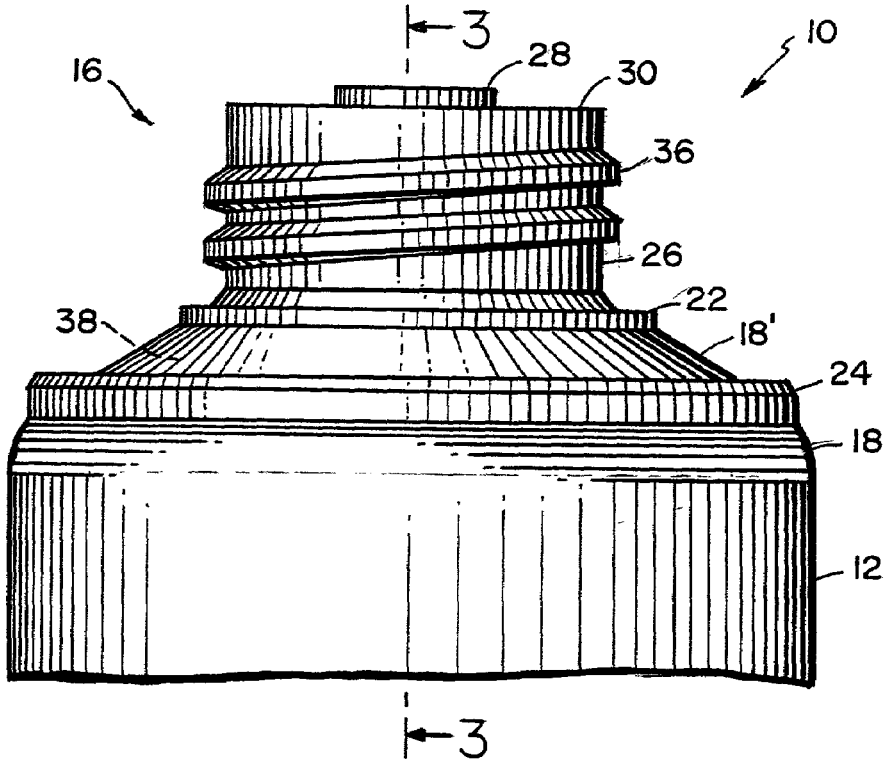
FIG. 2 is an enlarged, fragmentary, front view of an upper portion of the container of FIG. 1.
Figure 3:
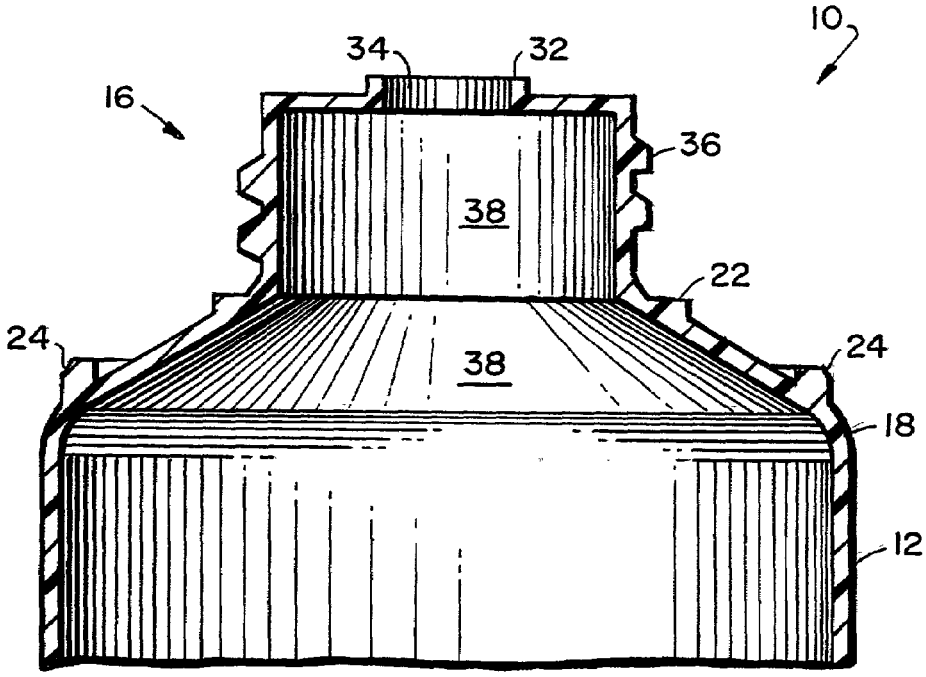
FIG. 3 is a cross-sectional view taken along a line 3—3 in FIG. 2.

FIGS. 1, 2, and 3 show a tube container of the present invention and is generally designated by reference numeral 10.

Tube container 10 has a body wall 12, which defines a chamber 14 therein. Tube container 10 also has a head 16, which has a shoulder 18 and a neck 20 extending therefrom. Shoulder 18 communicates between and joins neck 20 and body wall 12. Head 16 has a land portion 22, which is situated at the interface of neck 20 and shoulder 18. Shoulder 18 has a ridge 24 extending therefrom adjacent its periphery {the outer or circumferential edges of shoulder 18). Neck 20 has an outer neck 26 and a inner neck 28. Neck 20 further has a seat 30 that communicates between and joins outer neck 26 and inner neck 28. Inner neck 28 has an orifice 32 therein and a bore 34 therethrough. Orifice 32 communicates with an antechamber 38 and chamber 14 through bore 34. Outer neck 26 has exterior thread or threads 36 that are adapted to receive an internal thread or threads from a closure or dispenser.

Figure 4:
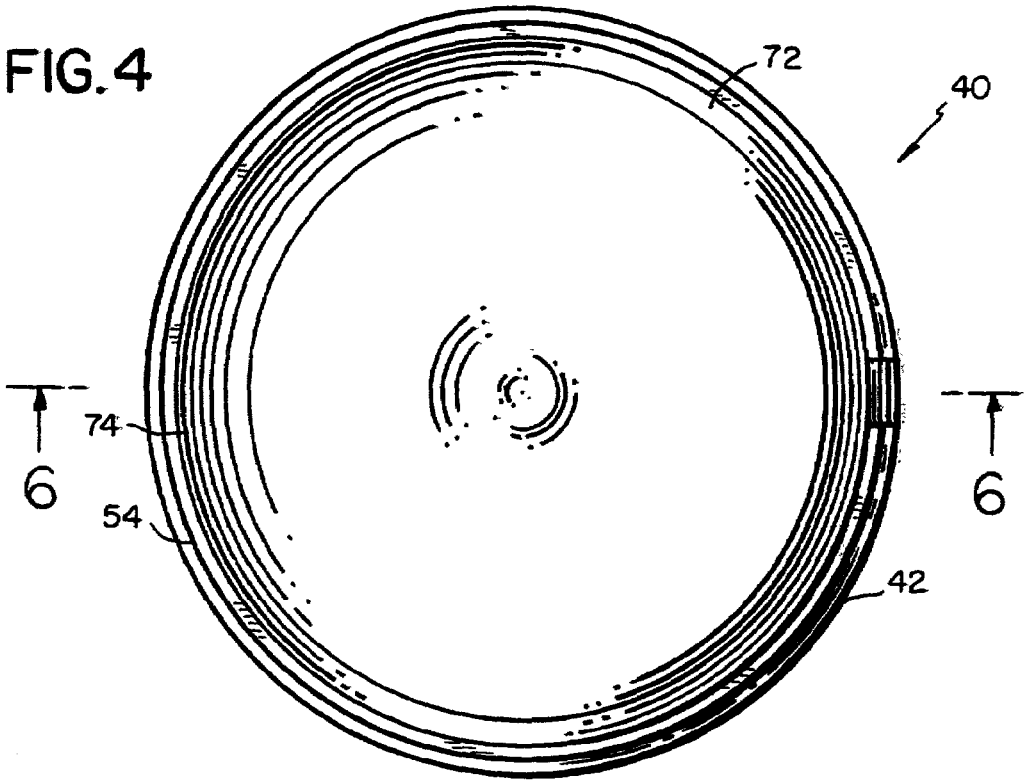
FIG. 4 is a top view of a tube container according to the present invention with a cap shown in engagement with the head of the tube container
Figure 5:
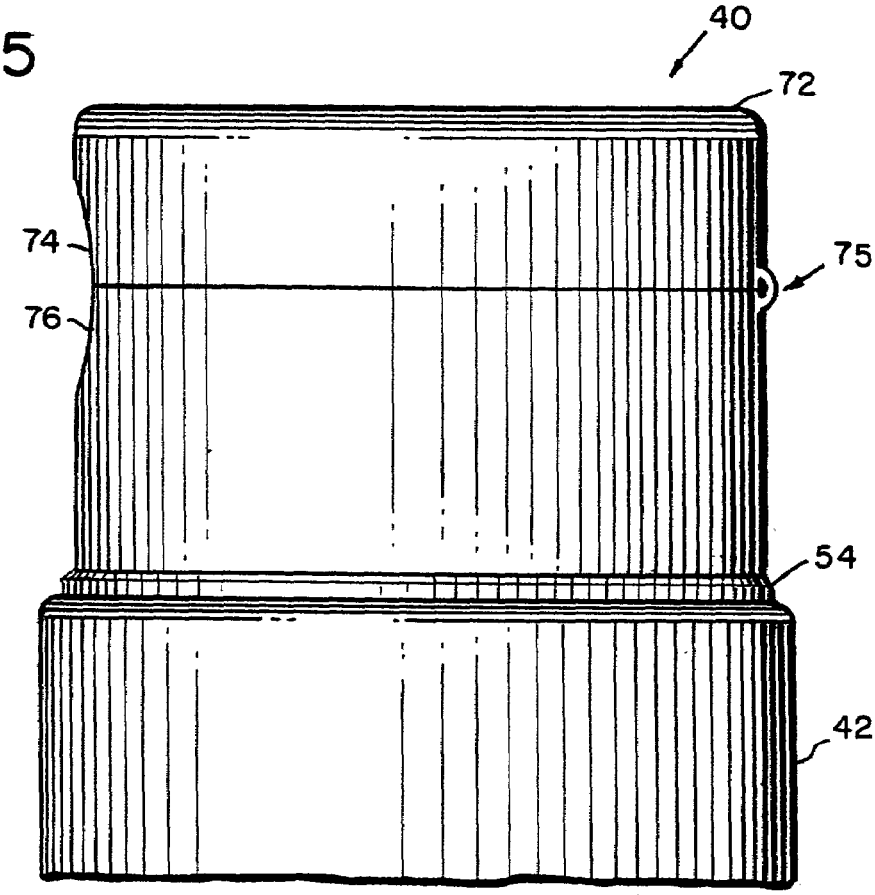
FIG. 5 is an enlarged, side view of the tube container of FIG. 4 according to the present invention.
Figure 6:
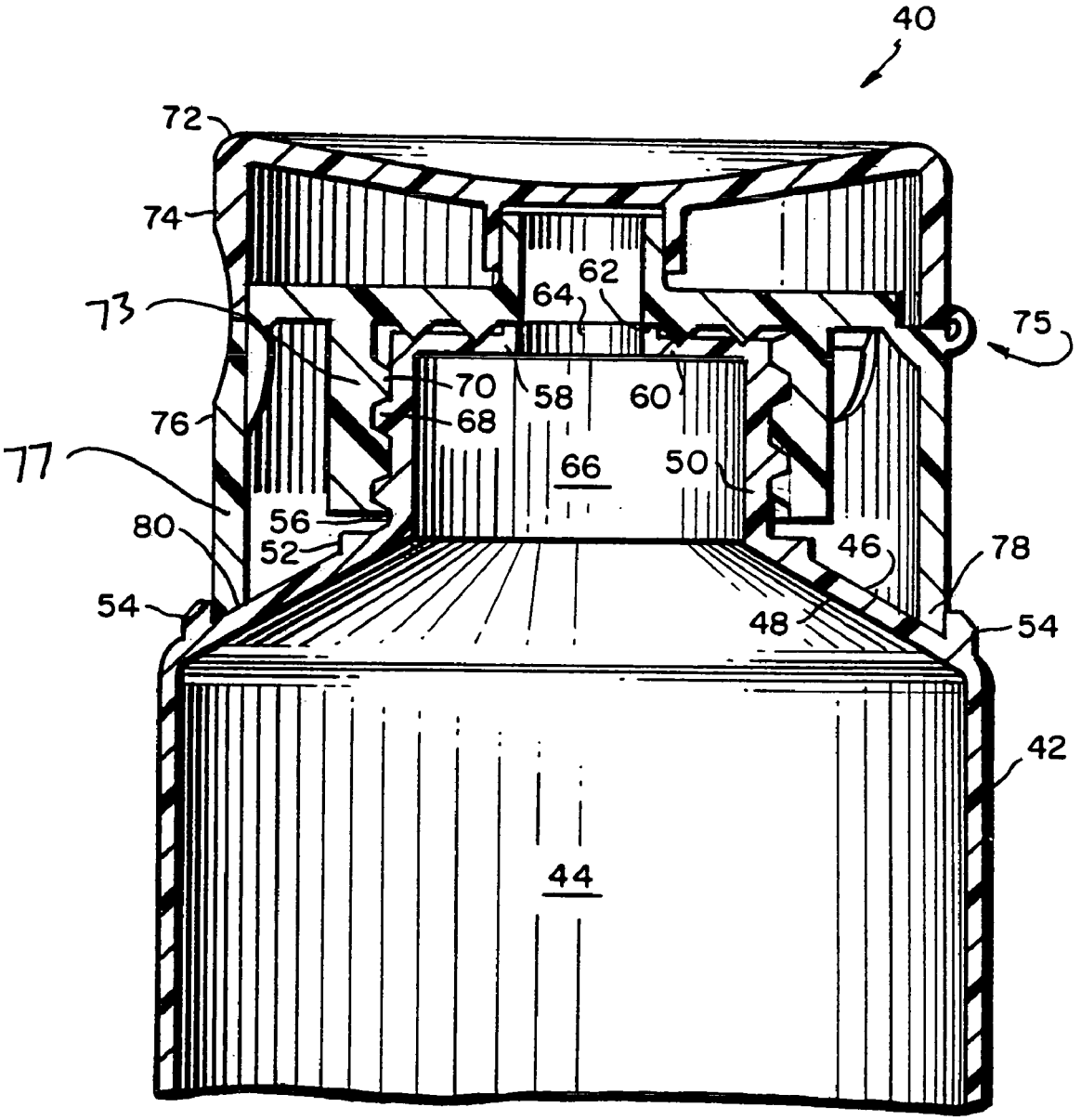
FIG. 6 is a cross-sectional view of the tube container of FIG. 4 taken along a line 6—6.

FIGS. 4 and 5 show another tube container of the present invention and is generally designated by reference numeral 40. Tube container 40 has a body wall 42, which defines a chamber 44 therein. Tube container 40 also has a head 46, which has a shoulder 48 and a neck 50 extending therefrom. Shoulder 48 communicates between and joins neck 50 and body wall 42. Head 46 has a land portion 52, which is situated at the interface of neck 50 and shoulder 48. Shoulder 48 has a ridge 54 extending therefrom adjacent its periphery {the outer or circumferential edges of shoulder 48) and directional with respect to neck 50. Neck 50 has an outer neck 56 and a inner neck 58. Neck 50 further has a seat 60 that communicates between and joins outer neck 56 and inner neck 58. Inner neck 58 has an orifice 62 therein and a bore 64 therethrough. Orifice 62 communicates with an antechamber 66 and chamber 44 through bore 64. Outer neck 56 has exterior thread or threads 68 that are adapted to receive an internal thread or threads 70 from a closure 72, which is shown in FIG. 5. Closure 72 has a base 76 that is screwed onto outer neck 56 and a flippable or detachable cap 74, which is flexibly attached to base 76 via strut 75. Base 76 has an inner skirt 73 and an outer skirt 77. Outer skirt 77 has an outer surface 79. Base 76 and outer skirt 77 have a contact edge 78, which extends circumferentially around base 76 and rests inside and adjacent to ridge 54 to prevent the infiltration of water through crevice 80 between stationary base 76 and shoulder 48. Ridge 54 extends along and adjacent outer surface 79 of outer skirt 77 above contact edge 78. Inner skirt 73 has internal thread or threads 70.

Figure 7:
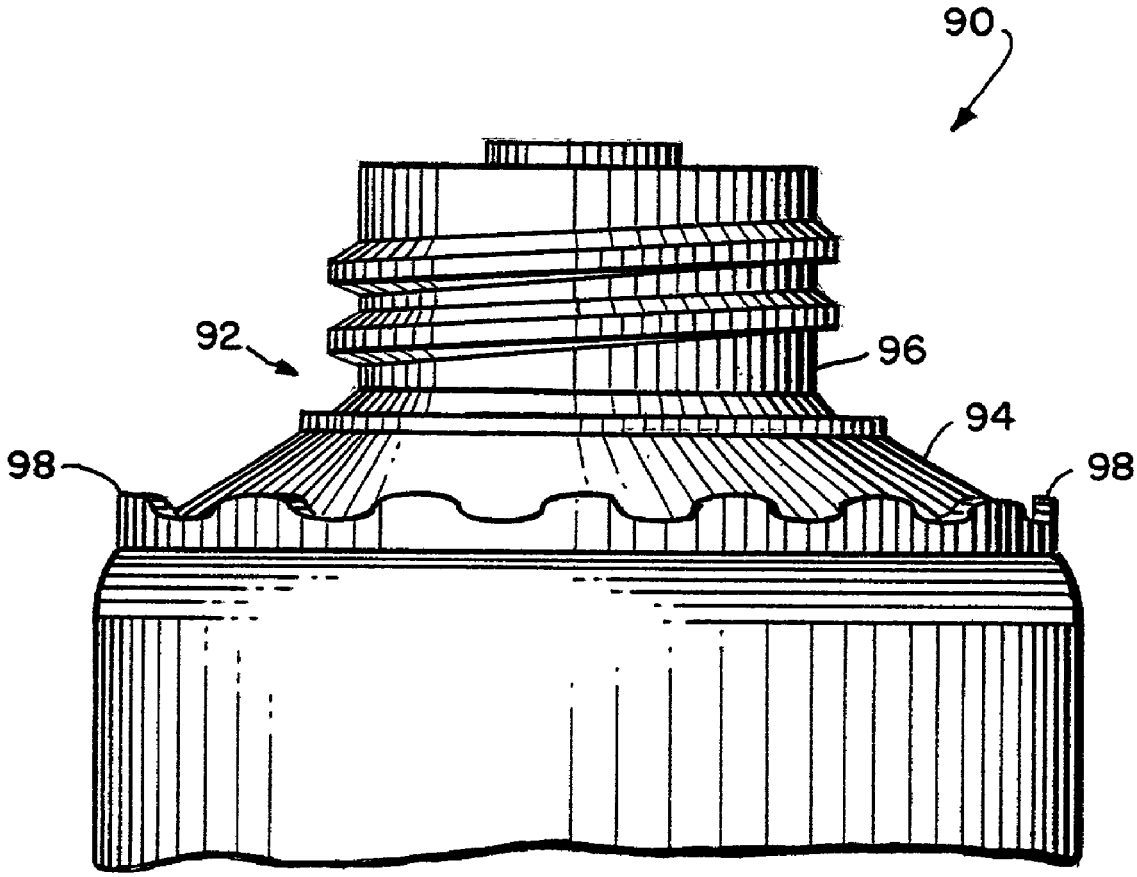
FIG. 7 is an enlarged, fragmentary, front view of an upper portion of another embodiment of the tube container of the present invention.

FIG. 7 shows a tube container of the present invention and is generally designated by reference numeral 90. Tube container 90 has a head 92, which has a shoulder 94 and a neck 96 extending therefrom. Shoulder 94 has a ridge 98 that extends therefrom adjacent to and around its periphery. Ridge 98 has an undulated or wavy configuration along its top or upper portion as it extends around shoulder 94.

The ridge on the shoulder of the head of the tube container is located adjacent to the periphery of the shoulder. The ridge is preferably closer to the periphery of the shoulder than to the neck of the head. The ridge preferably extends continuously around the shoulder in the vicinity of the periphery thereof.

The ridge can also be discontinuous, but must extend continuously or continually to a degree or an extent sufficient to ensure that water infiltration is substantially prevented. The contact edges of the cap may be positioned inside or outside the ridge when the cap is engaged with the head of the tube container. The ridge may be the same or a different color than the tube, cap, or remainder of the head.

Tube containers may be produced by any method known in the art such as extrusion or lamination. In extrusion, a plastic tube is extruded continuously then cut into discrete lengths that form the body wall of the tube. A tube head is then heat welded or adhered to one end of a tube length and a closure, cap or top is applied to the head. The other open end of the tube length is typically filled with product to be dispensed and then sealed by heat or mechanical means. In lamination, a sheet of plastic material or composite such as plastic/metal is rolled to a tubular shape and sealed along the sheet edges to form a continuous tube. The tube is cut into discrete lengths, head and cap applied, filled with product at the open end, and end sealed in the same manner as an extruded tube.

The closure and head may be manufactured according to any method known in the art such as injection molding or stamping with a plastic material. Injection molding is preferred.

The tube container may be manufactured from any plastic material known in the art. Representative plastic materials include ethylene polymers, propylene polymers, polyesters, and polyamides. Useful ethylene polymers include low density polyethylene, medium density polyethylene, high density polyethylene and linear low density polyethylene. A useful propylene polymer is polypropylene. Useful polyesters include polyethylene terephthalate. Preferred plastic materials are low density polyethylene and polypropylene.

It should be understood that the foregoing description is only illustrative of the present invention. Various alternatives and modifications can be devised by those skilled in the art without departing from the invention. Accordingly, the present invention is intended to embrace all such alternatives, modifications and variances which fall within the scope of the appended claims.

What is claimed is:

1. A tube container, comprising:

a) a body wall, the body wall defining a chamber therein;

b) a head, the head having a shoulder, the head having a neck extending from the shoulder, the neck having an orifice therein and a bore therethrough in communication with the orifice and the chamber, the shoulder further having a single ridge extending therefrom adjacent its periphery and directional with respect to the neck;

c) a closure, the closure having a base and a cap flexibly attached to the base, the closure being engaged with the shoulder, the base having an inner skirt and an outer skirt, the inner skirt being in engagement with and extending along at least a majority of the length of the neck, the outer skirt having an outer surface and a contact edge resting inside the ridge, the ridge extending along and adjacent the outer surface of the outer skirt above the contact edge, the ridge substantially blocking infiltration of water between the closure and the shoulder, and the container being a plastic tube container.

2. The tube container of claim 1, wherein the contact edge of the closure rests entirely inside of an adjacent to the ridge.

3. The container of claim 2, wherein the ridge is closer to the periphery of the shoulder than the neck.

4. The container of claim 3, wherein the ridge extends continuously around the shoulder.

5. The container of claim 1, wherein the shoulder is substantially circular in shape and the ridge is substantially circular in shape.

6. The container of claim 1, wherein the closure has an internal thread, wherein the neck has an external thread adapted to receive the internal thread of the closure.

7. The container of claim 6, wherein the shoulder is substantially circular in shape and the ridge is substantially circular in shape.

8. The container of claim 1, wherein the ridge is of a different color than the remainder of the head.

9. The container of claim 7, wherein the ridge extends continuously around the shoulder.

10. The container of claim 1, wherein the ridge extends continuously around the shoulder.

11. The tube container of claim 1, wherein the tube container is adapted to being stood on end with the closure facing down, and wherein the ridge is located closer to the periphery of the shoulder than the neck.

12. The tube container of claim 4, wherein the tube container is adapted to being stood on end with the closure facing down, and wherein the ridge is located closer to the periphery of the shoulder than the neck.

13. The tube container of claim 9, wherein the tube container is adapted to being stood on end with the closure facing down, and wherein the ridge is located closer to the periphery of the shoulder than the neck.

* * * * *